US011667016B2

(12) United States Patent
Archer

(10) Patent No.: US 11,667,016 B2
(45) Date of Patent: Jun. 6, 2023

(54) AUTO WINDOW BELT MOLDING REMOVAL TOOL

(71) Applicant: Rusty Charles Archer, Pueblo, CO (US)

(72) Inventor: Rusty Charles Archer, Pueblo, CO (US)

( * ) Notice: Subject to any disclaimer, the term of this patent is extended or adjusted under 35 U.S.C. 154(b) by 192 days.

(21) Appl. No.: 17/371,104

(22) Filed: Jul. 9, 2021

(65) Prior Publication Data

US 2023/0008300 A1 Jan. 12, 2023

(51) Int. Cl.
*B25B 27/00* (2006.01)

(52) U.S. Cl.
CPC ..... *B25B 27/0092* (2013.01)

(58) Field of Classification Search
CPC ..... B23P 19/00; B23P 19/04; B66F 15/00; B25B 27/00; B25B 27/02
See application file for complete search history.

(56) References Cited

U.S. PATENT DOCUMENTS

| | | | | |
|---|---|---|---|---|
| 7,896,414 | B1 * | 3/2011 | Brigham | B65G 7/12 294/25 |
| D665,641 | S * | 8/2012 | Raleigh | D34/10 |
| D813,977 | S * | 3/2018 | Reese | D22/134 |
| D874,906 | S * | 2/2020 | Ruddick | D8/356 |
| D877,854 | S * | 3/2020 | Malcarne | D22/149 |
| 11,058,239 | B2 * | 7/2021 | Campbell | B65G 7/12 |
| 2007/0089355 | A1 * | 4/2007 | Burgett | A01K 97/18 43/53.5 |
| 2020/0187480 | A1 * | 6/2020 | Adams | A01K 97/14 |

* cited by examiner

*Primary Examiner* — Lee D Wilson

(57) ABSTRACT

The auto window belt molding removal tool is for removing the auto window belt molding from the auto body door panel. This thin strong tool has a thin handle at one end of the shaft, at the other end is a hook with a unique flat angle. Easily inserted between the auto window and the auto window belt molding, with a twist to align the unique flat angle to get purchase on the auto window belt molding and detach it from the retainer.

5 Claims, 3 Drawing Sheets

AUTO WINDOW BELT MOLDING REMOVAL TOOL

RELATED APPLICATIONS

The present invention claims priority on provisional patent application, Ser. No. 63/050,854, filed on Jul. 12, 2020, entitled "Auto window belt removal tool" and is hereby incorporated by reference.

FIELD OF THE INVENTION

The present invention relates generally to the field of automotive repair.

BACKGROUND OF THE INVENTION

Auto body repair and paintless dent repair (pdr) technicians are in need of a way to remove the auto window belt moldings without damaging for paint, pdr or replacement. There are some window belt removal tools out there. A common problem with those are distance needed between the auto window glass and the auto window belt molding to gain access with their tools. Automotive vehicles manufactured today have tighter tolerance spec's, laminated glass and rear door windows that do not roll all the way down. This makes it more difficult to create space between the auto window glass and auto window belt molding to insert a wide and cumbersome tool. A lot of auto window belt moldings today do not have clips. They are manufactured with a raised inverted edge to grasp metal punch outs, manufactured on auto metal door frames. This creates another problem for older, wider tools possibly attaching to punch outs on metal door frames.

SUMMARY OF INVENTION

The auto window belt removal tool is used to remove auto window belt molding without damage to auto window belt molding for reinstallation after work is performed to auto body door panel.

Minimal distance is needed to insert tool between auto window glass and auto window belt molding. Once inserted, tool is twisted to square up unique edge of hook to the bottom of the auto window belt molding. Allowing the auto window belt molding tool to detach the auto window belt molding from being retained.

The thin strong unique design, allows for access into the tightest spaces and removal of auto window belt moldings with today's characteristics. Consists of a thin rod (round/square/hex), with a slight bend to the shaft. Handle on one end of the shaft, on the other end a formed hook with a unique angle (grinded/formed) to allow the end to be squared up with the auto window belt molding when slightly twisted.

The features of the present invention will be apparent upon further review of the following specification and drawings.

DETAILED DESCRIPTION OF THE INVENTION

Figure 1:
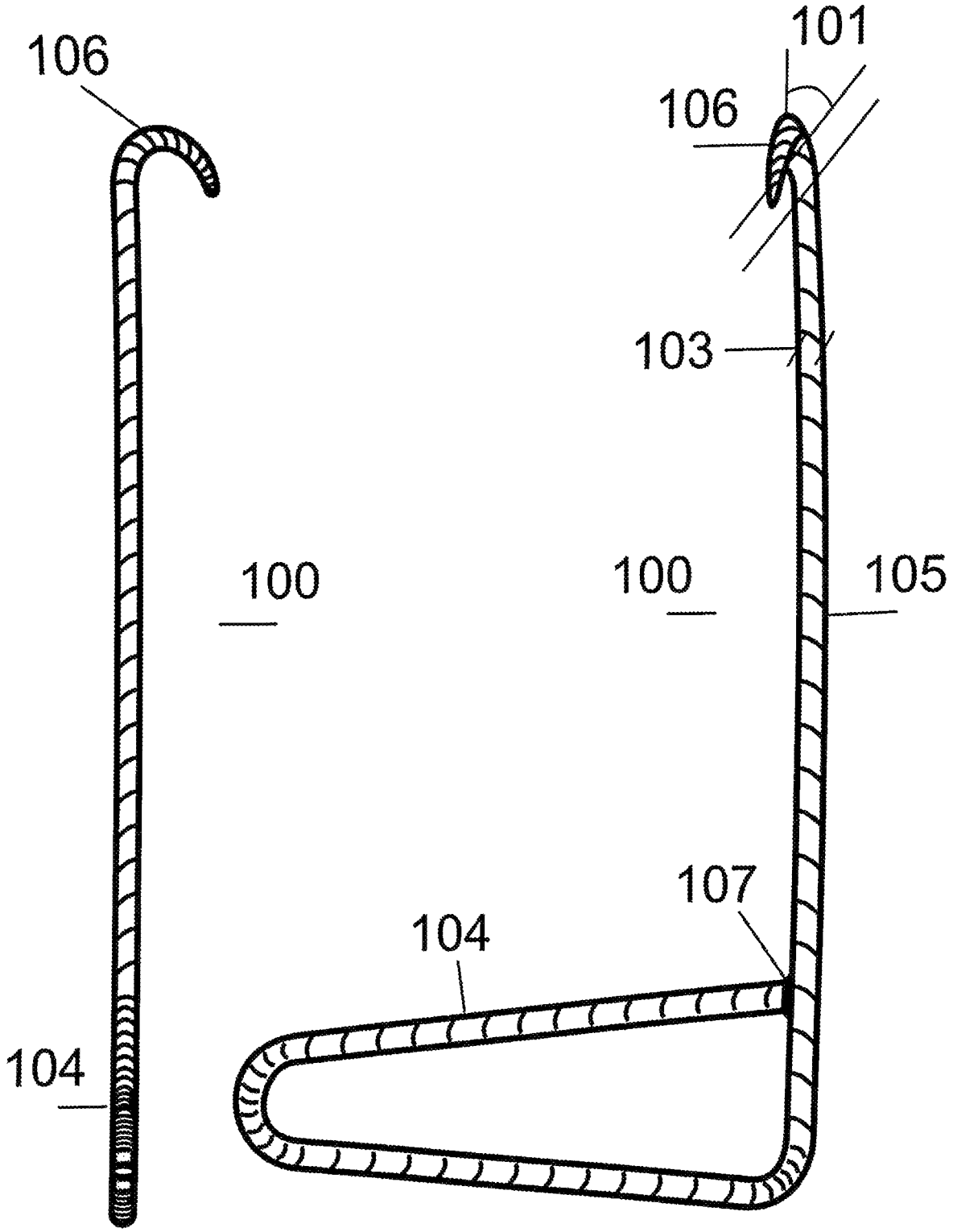
FIG. 1 is an overhead view of the tool.
Figure 2:
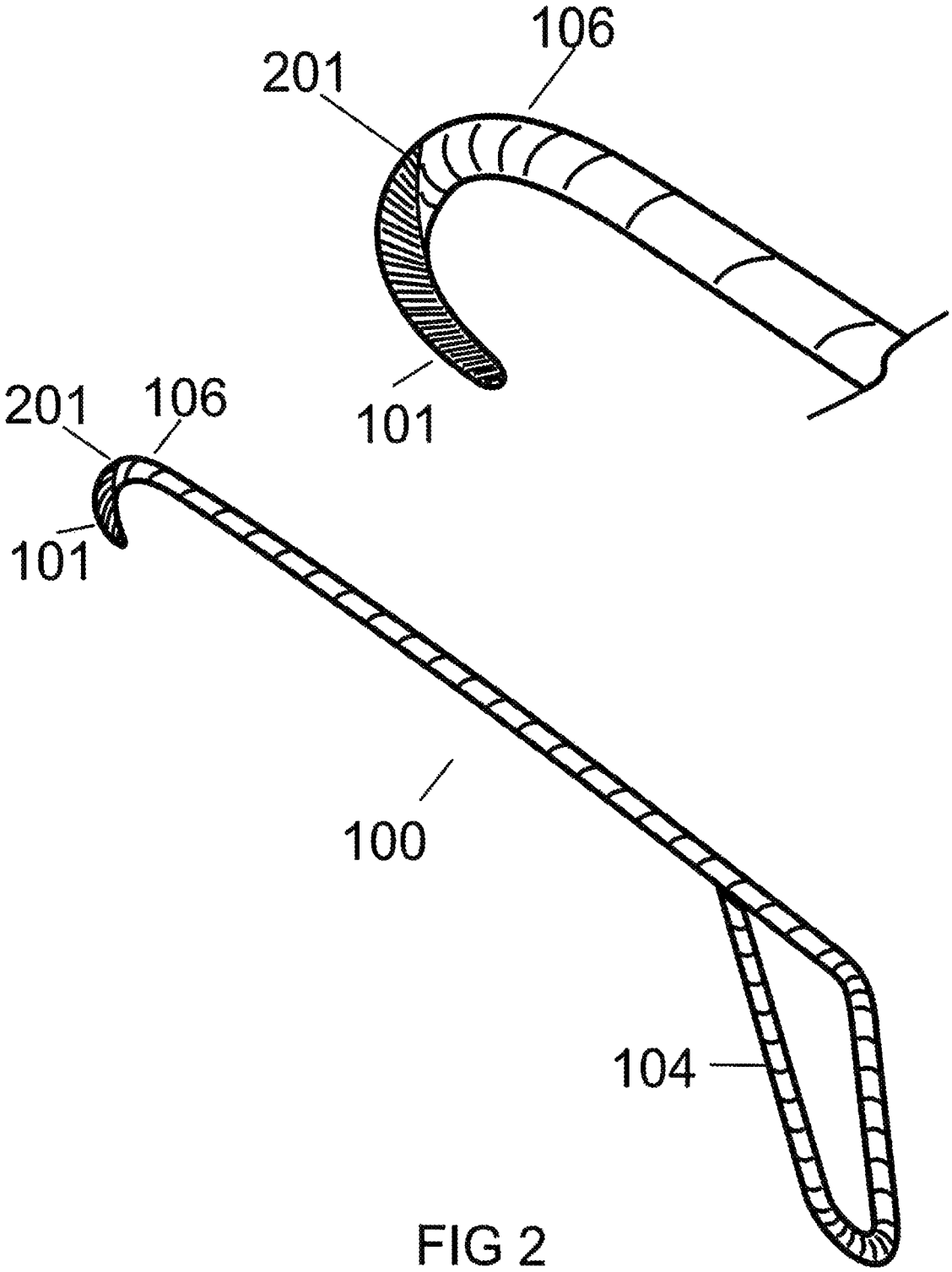
FIG. 2 is an expanded view of the tool.
Figure 3:
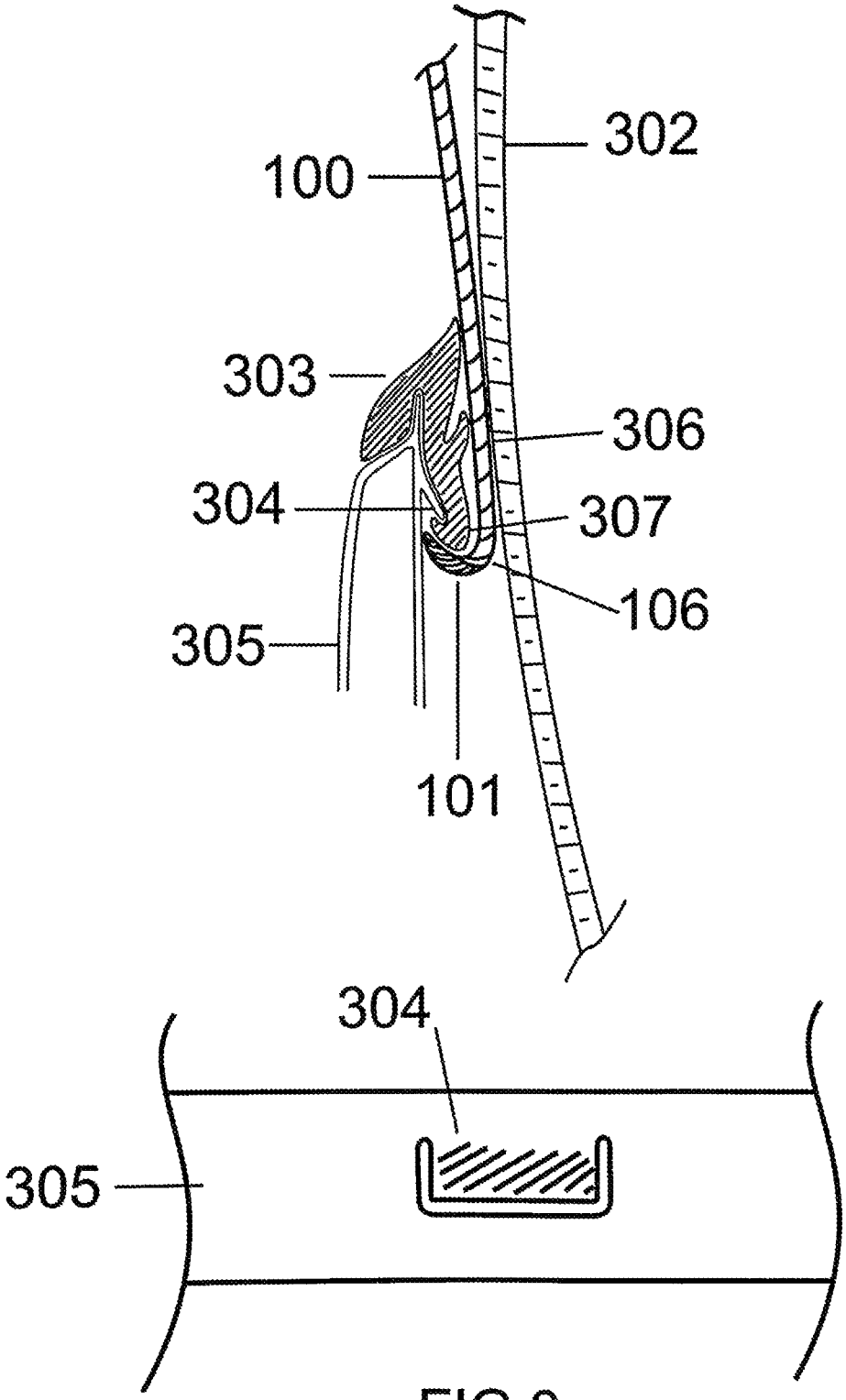
FIG. 3 is a view of how the tool attaches.

As shown in FIGS. 1-2, the present invention is a tool 100 is made from one piece of metal, bent and formed. A thin strong metal rod 103 0.125±0.0156, requiring minimum space for access.

At one end is the handle 104, made from 2 bends and attached 107 back to the shaft 105 to allow a comfortable clean feeling and control of the tool 100 to finesse the removal of the auto belt molding.

The thin strong metal shaft 105 is of enough length to control and to remain rigid to remove auto belt molding. The shaft has a slight curve as to keep minimal contact from the auto window glass 302. Strait works curve is better.

At the other end of the shaft 105 is the turned up back end, the hook 106. The hook 106 is 90 deg. offset from the handle 104. The hook 106 end has a unique angle 101 45 deg.±5 deg. (grinded/formed) to the shaft. Allowing access in minimal space 306, then twist handle 104 to square up unique angle 101 and gain purchase on auto belt molding 307. From the center of inside bottom of hook 201 starts the taper of the unique angle 101 and continues to the tip of hook 106.

While the invention has been described in conjunction with specific embodiments thereof, it is understood that the invention is only limited by the scope of the following claims.

The invention claimed is:

1. A tool for auto window belt molding removal, comprising: a handle being formed in a triangular shape with on an elongated shaft having a proximal end connecting at least two angles with all of said elements being planar and a second distal end of the shaft terminating in an offset hook end extending in a plane perpendicular to said planar plane with a flat angle formed from an inside center bottom of the offset hook which curves in a direction of the proximal end of the shaft, wherein the handle, shaft and hook are intergral cylindrical body.

2. The tool for auto window belt molding removal tool of claim 1, wherein the shaft is an arcuate curve.

3. The tool for auto window belt molding removal tool of claim 1, wherein the curve of the offset hook is a 170 depress with a range of plus or minus 10 degrees.

4. The tool for auto window belt molding removal tool of claim 1, wherein the flat angle is 45 degrees with a range of plus or minis 5 degrees.

5. The tool for auto window belt molding removal tool of claim 1, wherein the offset hook has a rounded end point.

* * * * *